United States Patent [19]

Luoma et al.

[11] Patent Number: 4,669,540

[45] Date of Patent: Jun. 2, 1987

[54] TOPPING AND TAMPING PLUG

[76] Inventors: Paavo Luoma, 11114 - 20 Avenue, Edmonton, Alberta, Canada; Jim Jackson, R.R. #2, Carvel, Alberta, Canada, T0E 0H0

[21] Appl. No.: 712,101

[22] Filed: Mar. 14, 1985

[30] Foreign Application Priority Data

Jan. 25, 1985 [CA] Canada ..... 472860

[51] Int. Cl.[4] ..... E21B 33/128; E21B 49/04

[52] U.S. Cl. ..... 166/135; 166/192; 175/1; 102/333

[58] Field of Search ..... 166/63, 192, 299, 135, 166/206, 123; 405/259; 102/333, 319, 304, 324; 299/13; 175/4.52, 1, 2

[56] References Cited

U.S. PATENT DOCUMENTS

| | | | |
|---|---|---|---|
| 2,450,366 | 9/1948 | Williams | 166/63 |
| 2,710,065 | 6/1955 | Hamilton, Jr. | 166/123 |
| 2,822,876 | 2/1958 | Murrow et al. | 166/192 |
| 3,039,534 | 6/1962 | Koop | 166/135 |
| 3,264,992 | 8/1966 | Beck | 102/30 |

FOREIGN PATENT DOCUMENTS

| | | | |
|---|---|---|---|
| 793772 | 8/1966 | Canada | 166/63 |
| 827427 | 11/1969 | Canada | 102/11 |
| 920508 | 2/1973 | Canada | 166/63 |
| 1010780 | 5/1977 | Canada | 166/63 |
| 1048405 | 2/1979 | Canada | 166/63 |
| 0977180 | 3/1951 | France | 102/333 |
| 0025121 | 12/1901 | Switzerland | 102/333 |

*Primary Examiner*—Stephen J. Novosad
*Assistant Examiner*—Bruce M. Kisliuk
*Attorney, Agent, or Firm*—Irvin A. Lavine

[57] ABSTRACT

There is provided a new and useful tamping and topping plug for use in a seismic bore hole, and comprising a cylindrical body member having a forward and a rearward end and terminating at its forward end with a closed end part, a plurality of elongated members extending outwardly and rearwardly from at least one end and preferably from the forward and rearward ends of the body member, the members so arranged as to give the plug axial stability when inserted into a bore hole. There is also provided a process utilizing the plug for enhancing information available from seismic blasting.

18 Claims, 9 Drawing Figures

TOPPING AND TAMPING PLUG

This application relates to tamping and topping plugs for bore holes.

BACKGROUND OF THE INVENTION

In carrying out a seismic exploration, a standard procedure is to drill holes into the geologic formations of interest and to plant explosive charges in the bore holes. The charges are then detonated and appropriate measurements recorded to enable evaluation of the formation.

There are a number of problems associated with this seismic drilling. One of these occurs during the actual blast. Unless the hole is properly plugged prior to detonation, a large proportion of the energy of the blast escapes upwardly through the hole and is thus not properly directed through the formation of interest.

There is therefore a continuing need for a bore hole plug which is simple and inexpensive in construction yet sufficiently durable to remain in place for extended periods and to withstand the force of the blast. To date, a variety of plugs have been proposed and used, but these do not satisfactorily meet all of the criteria set out above.

In addition, plugs are required to be inserted into bore holes to support concrete, earth or other topping materials used to close the hole. Accordingly, a simple plug which could withstand the force of the blast and remain in the hole as a topping plug would be highly desirable. Such a plug could be used as a topping plug only, if required.

The bore hole plug of the present invention is intended to alleviate the problems discussed.

PRIOR ART

Various types of tamping and topping plugs are known in the art, but none of these offer the advantages of the present invention.

Canadian Pat. No. 827,427, issued Nov. 18, 1969, to Ace Explosives Ltd. provides a drive point for explosive charges having some similarity in structure but used for a completely unrelated purpose.

Canadian Pat. No. 920,508, issued Feb. 6, 1973, to Ovelson, illustrates one form of topping plug for use subsequent to drilling and shooting of a seismic test hole. The device utilizes a flanged annular rim at right angles to a body section which rim has the facility of limited diametrical size adjustment.

Canadian Pat. No. 1,010,780, issued May 24, 1977, to Markicevic, provides another form of plug device for marking and plugging bore holes at the surface. The device is not intended to confine the blast to the hole.

Canadian Pat. No. 1,048,405, issued Feb. 13, 1979, to Bassani, provides a further form of hole plugging device for use in plugging holes following blasting.

U.S. Pat. No. 2,822,876, issued Feb. 11, 1958, to Murrow, et al., illustrates a form of bridging plug for use in plugging a bore hole or isolating a lower section of a well.

U.S. Pat. No. 3,264,992, issued Aug. 9, 1966, to Beck, illustrates a tamping plug comprising two parts which work together to plug a bore hole during blast in the hole.

Finally, Canadian Application Ser. No. 462,827 filed Sept. 10, 1984, by Jim Jackson, one of the inventors in the present case, illustrates a different form of tamping and topping plug for use in bore holes.

SUMMARY OF THE INVENTION

It is an object of the invention to produce a simple, effective and inexpensive topping and tamping plug.

Accordingly, a simple molded plastic device has now been developed which is light, economical, of one piece construction; and which is very effective in tamping and plugging bore holes to confine the force of the blast to the hole.

The invention thus provides a tamping and topping plug for use in a seismic bore hole, comprising a cylindrical body member having a forward and a rearward end, terminating at its forward end with a closed end part, a plurality of elongated members extending outwardly and rearwardly from at least one end of the body member, the members so arranged as to give the plug axial stability when inserted into a bore hole.

In a preferred embodiment the elongated members extend from the front and rear ends of the body member.

There is further provided a process for enhancing the information obtainable from seismic blasting comprising inserting into a seismic borehole in which an explosive charge has been placed, and above the said charge, a tamping plug comprising a cylindrical body member having a forward and a rearward end and terminating at its forward end with a conical end part, a plurality of elongated members extending outwardly and rearwardly from at least one end of the said body member, said members so arranged as to give said plug axial stability when inserted into a bore hole; then exploding the charge and taking seismic readings.

BRIEF DESCRIPTION OF THE DRAWINGS

In drawings which illustrate embodiments of the invention.

Figure 1:
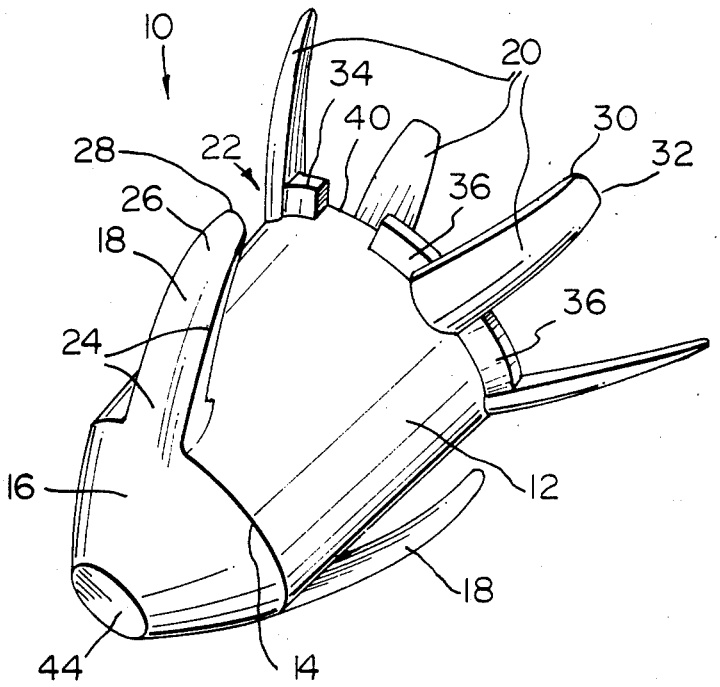
FIG. 1 is a perspective view of a plug according to the invention.
Figure 4:
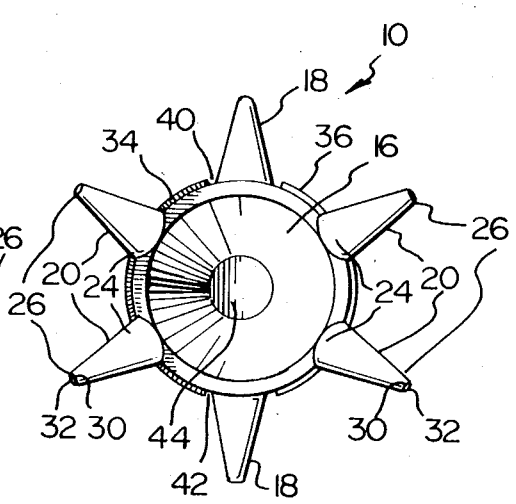
FIG. 4 is a rear plan view of a plug according to the invention.
Figure 3:
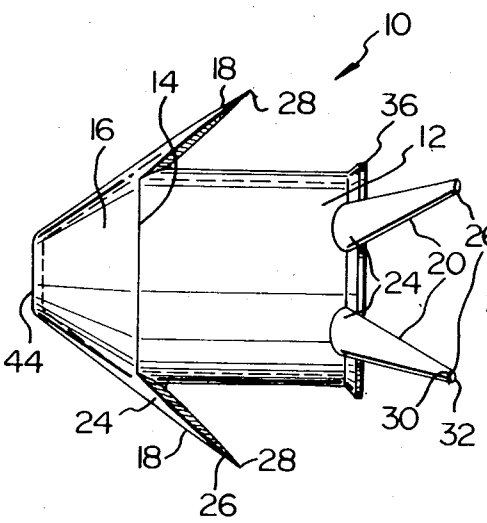
FIG. 3 is a side elevation of a plug according to the invention.
Figure 2:
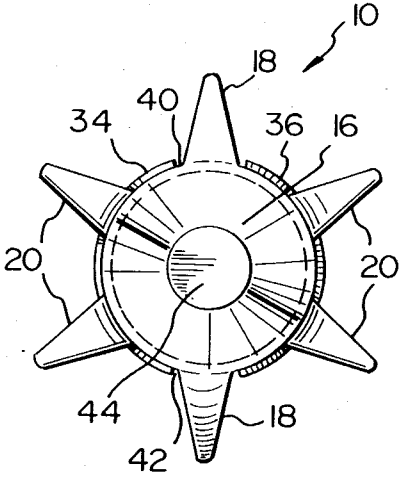
FIG. 2 is a front plan view of a plug according to the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

The plug 10 includes a body section 12 of cylindrical configuration. The plug is preferably formed of a resilient material such as elastomer or a plastic. The forward end 14 of the body section 12 terminates in the illustrated embodiment in a truncated conical end section 16.

The end section 16 may be profiled in a number of different configurations other than conical. For example, hemispherical, pyramidal or flat end sections 16 would also serve. It is basically only required that the end 14 be substantially closed.

The most preferred embodiment of end section 16, however, is the illustrated truncated cone.

A series of elongated members of claws 18 and 20 protrude outwardly and rearwardly from the front 14 and rear 22 of the body section 12. These members are integral with the body section 12.

While various configurations of the individual members 18 and 20 would be acceptable, it is preferred that the width and thickness both decrease from the base 24 to the outer extremity 26 of the said members. As illustrated, the forward members 18 are molded to smoothly taper to an edge 28; while the rearward members 20 are somewhat thicker and are bevelled at 30 toward the ends 32.

The front and rear claws 18 and 20 are as a group preferably arranged in a symmetrical fashion about the plug body 12. The plug 10 thereby has good directional stability in the bore hole and is prevented from becoming misaligned on insertion or with the force of the blast. In the preferred configuration the plug includes two forward claws 18 and four rear claws 20.

A pair of flange sections 34 and 36 extend around a major part of the rear end 38 of the body section 12. These flange sections leave spaces 40 and 42 behind the forward claws 18. The flange sections 34 and 36, when the plug is in use, fit closely to the sides of the bore hole to reduce blast leakage around the sides of the plug. In the preferred embodiment the flange sections are in part integral with the rear claws 20. In this situation the flange sections play an important reinforcing role in aiding the members 20 to withstand the force of the blast.

Figure 5:
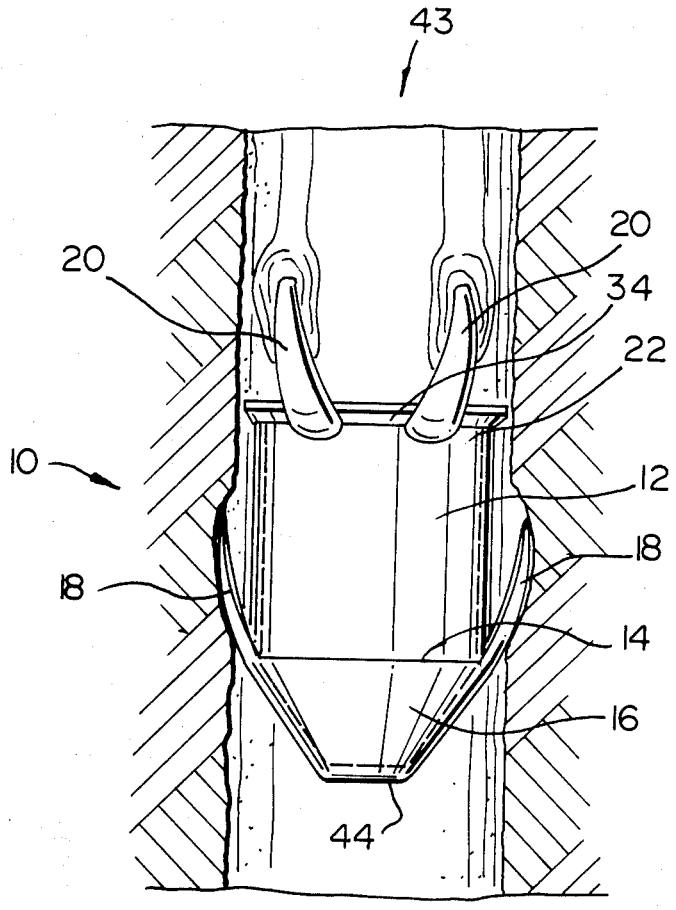
FIG. 5 illustrates a plug according to the invention located in a bore hole prior to a blast.
Figure 9:
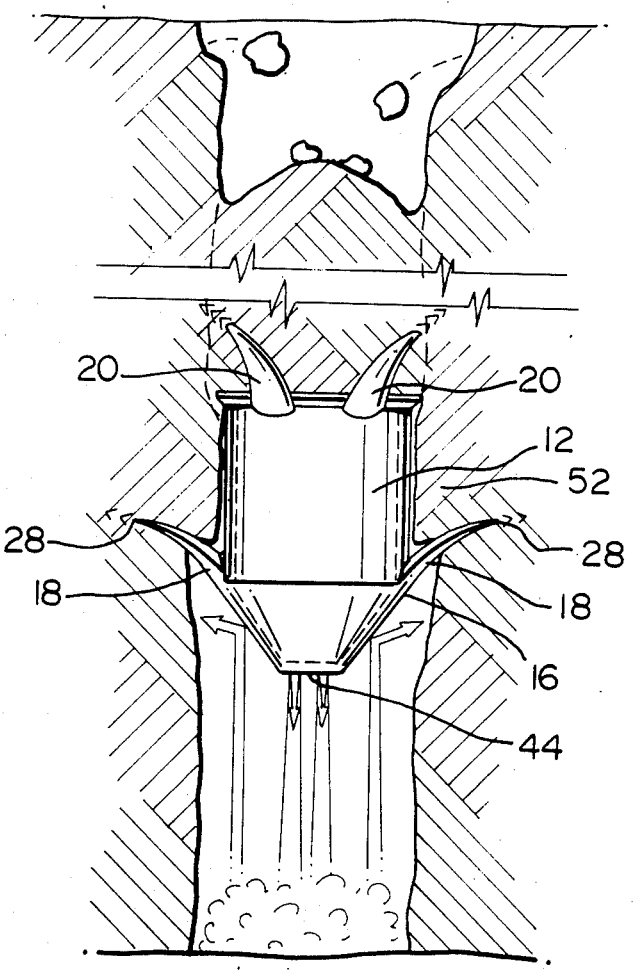
FIG. 9 illustrates the embodiment of FIG. 5 after the blast.

The manner of use of the plug is as follows. After a hole 43 has been drilled and the explosive charge planted in the hole. The plug of the present invention is inserted into the hole. The charge is then exploded. The force of the explosion causes a flexing of the plug and causes the plug to move up the hole slightly. This serves to set the claws 18 and 20 into the sides of the hole to confine the blast. A comparison of FIGS. 5 and 9 illustrates clearly the position before and after the blast.

The setting of the claws in this manner is aided by the extra force which is brought to bear on the plug by reason of the flat portion 44 of the truncated conical end 16. Thus a fairly flat such end portion is highly preferred.

In this way the force of the blast is substantially confined to the hole and so to the surrounding formations.

The plug 10 is then normally left in the hole as a topping plug and the filling material, such as concrete, then poured in on top. In use the upward force exerted by the plug during the blast looses a substantial amount of material from the walls 52 (FIG. 9) of the hole which material then becomes topping fill.

Figure 8:
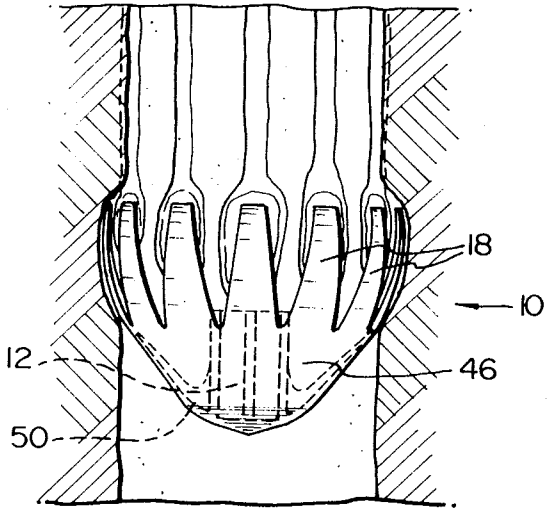
FIG. 8 illustrates the embodiment of FIGS. 6 and 7 in use in a bore hole prior to a blast.
Figure 7:
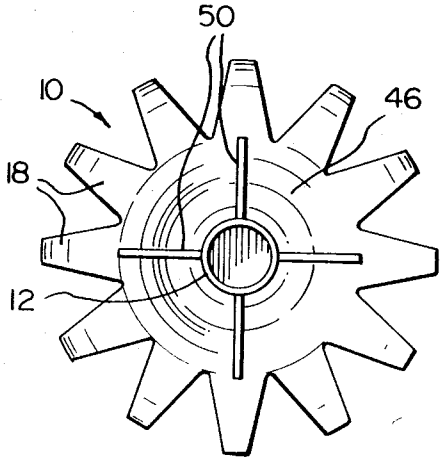
FIG. 7 is a rear plan view of the embodiment of FIG. 6.
Figure 6:
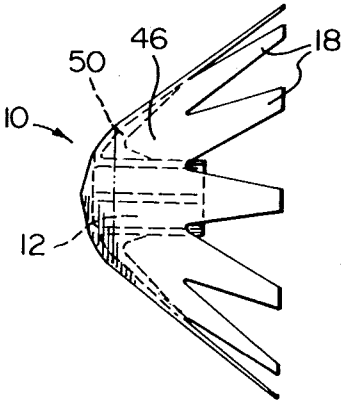
FIG. 6 is a side elevation of a further embodiment of the invention.

A further embodiment of the invention is illustrated in FIGS. 6 to 8. In some situations of intermediate diameter bore holes that embodiment may be found to be preferable.

With reference to FIGS. 6 to 8, the body member 12 has a flattened conical end part 16 from which a series of integral elongated members 18 emanate. The members 18 are integral with each other in the area near the end section 16 to form a screen section 46.

In use the diameter of the extremity 48 of the screen section 46 is chosen to approximate the diameter of the bore hole in which the plug is to be used. The screen section 46 thereby ensures that the blast is confined.

The plug of this embodiment preferably includes a series of support and stiffening webs 50 extending between body member 12 and screen section 46. The webs 50 preferably extend to near the outer extremity of screen section 46 and so preferably approximate the diameter of the hole in which the plug is to be used. The webs 50 also aid in maintaining the directional stability of the plug, This embodiment operates in the same manner as that described earlier. The explosive charge is placed in the bore hole and the plug of the invention inserted thereafter. The charge is then exploded causing the plug to flex and move slightly up the hole, thus setting the claws 18 in the walls of the hole in the manner illustrated for the first plug type illustrated in FIG. 9.

A further embodiment similar to that of FIGS. 6 to 8 may be utilized in which the members 18 extend from the rear end of the body member 12. That embodiment is less preferred because it is less directionally stable in the face of a blast.

Thus it is apparent that there has been provided in accordance with the invention tamping and topping plug for bore holes that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. A tamping and topping plug for use in a seismic bore hole, and comprising:

a cylindrical body member having a forward and rearward end and terminating at its forward end with a somewhat flattened end part;

means for providing axial stability to said plug agaainst movement out of a borehole when inserted into a bore hole and subjected to the force of an explosive charge detonated in the bore hole in advance of the forward end of said body member, said means comprising a plurality of elongated members extending outwardly and rearwardly from at least one end of the said body member so that said members are caused to set in the walls of the bore hole upon slight movement of the plug due to the force of a detonated explosive charge.

2. The plug of claim 1 in which the said elongated members extend from at least the forward end of the said body member.

3. The plug of claim 1 in which the configuration of the said end part is chosen from the group consisting of a hemisphere, a truncated pyramid, a truncated cone and a flat surface.

4. The plug of claim 1 in which the configuration of the said end part is a truncated cone.

5. The tamping and topping plug of claim 1, wherein said plug comprises means fitting closely to the sides of the borehole for reducing blast leakage around the plug.

6. A tamping and topping plug for use in a seismic bore hole, and comprising:

a cylindrical body member having a forward and rearward end and terminating at its forward end with a somewhat flattened end part;

means for providing axis stability to said plug against movement out of a borehole when inserted into a bore hole and subjected to the force of an explosive charge detonated in the bore hole in advance of the forward end of said body member, said means comprising a plurality of elongated members extending outwardly and rearwardly from at least the rearward end of the said body member so that said members are caused to set in the walls of the bore hole upon slight movement of the plug due to the force of a detonated explosive charge.

7. A tamping and topping plug for use in a seismic bore hole, and comprising:

a cylindrical body member having a forward and rearward end and terminating at its forward end with a somewhat flattened end part;

means for providing axial stability to said plug against movement out of a borehole when inserted into a bore hole and subjected to the force of an explosive charge detonated in the bore hole in advance of the forward end of said body member, said means comprising at least two elongated members at each of the said forward and rearward ends of said body member so that said members are caused to set in the walls of the bore hole upon slight movement of the plug due to the force of a detonated explosive charge.

8. The plug of claim 5 in which the said end part is a cone.

9. The plug of claim 8 in which the said cone is truncated.

10. The plug of claim 7, 8 or 9 in which the plug is resilient and is formed of an elastomeric or plastic material.

11. The plug of claim 9 in which the said device is formed of a resilient elastomer or plastic and in which said elongated members are tapered from said body member to their extremeties.

12. The plug of claim 10 in which at least two of the said elongated members are located at each of the forward and rearward ends of the said body member and wherein the said members are located symmetrically about the circumference of said body member.

13. The plug of claim 11 in which four said elongated members are located symmetrically about a diameter at the rearward end and two said elongated members are located symmetrically about a diameter at the forward end of said body member, and the six said elongated members are substantially equispaced about the circumference of the said body member.

14. A tamping and topping plug for use in a seismic bore hole, and comprising:

a cylindrical body member having a forward and rearward end and terminating at its forward end with a somewhat flattened end part;

means for providing axial stability to said plug against movement out of a borehole when inserted into a bore hole and subjected to the force of an explosive charge detonated in the bore hole in advance of the forward end of said body member, said means comprising a plurality of elongated members extending outwardly and rearwardly from at least one end of the said body member so that said members are caused to set in the walls of the bore hole upon slight movement of the plug due to the force of a detonated explosive charge, wherein the plug material is resilient, in which the said end part is curved convexly or is conical in configuration, and in which a plurality of said elongated members extend integrally from said front part, said elongated members being integral with each other near the said body member to form a screen section extending outwardly and backwardly from the forward edge of said body member.

15. The plug of claim 14 in which the diameter of the extremity of said screen section is approximately equal to the diameter of the bore hole in which the plug is to be used.

16. The plug of claim 14 including a series of reinforcing webs between said body member and said screen section.

17. A topping and tamping plug for a bore hole for withstanding the force of a blast from an explosion therein comprising:

a cylindrical body member having a forward end directed toward an explosive charge while in place and a rearward end, said forward end having a flattened end part, and means extending from said body settable into the sides of a bore hole upon upward movement of said plug under the force of an explosion in said bore hole beneath said body, said settable means permitting insertion of said plug into a bore hole with the forward end in advance of the rearward end, said plug comprising means fitting closely to the side of the borehole for reducing blast leakage around the plug.

18. The topping and tamping plug of claim 17, said means comprising resilient elongated members extending outwardly and rearwardly from said body member.

* * * * *